US005676412A

United States Patent [19]

Kahley

[11] Patent Number: 5,676,412

[45] Date of Patent: Oct. 14, 1997

[54] FOLDING SNOW SHOVEL

[76] Inventor: Alan W. Kahley, R.D. #3, Box 362, Bloomsburg, Pa. 17815

[21] Appl. No.: 720,957

[22] Filed: Oct. 4, 1996

[51] Int. Cl.[6] ..... E01H 5/02

[52] U.S. Cl. ..... 294/53.5; 294/54.5; 294/57

[58] Field of Search ..... 294/49, 50.6, 50.8, 294/51, 53.5, 54.5, 57, 59; 37/265, 283–285; 172/371–374

[56] References Cited

U.S. PATENT DOCUMENTS

| | | | |
|---|---|---|---|
| 122,206 | 12/1871 | Wetmore | 294/51 |
| 1,475,899 | 11/1923 | Thirbault | 294/49 |
| 2,432,780 | 12/1947 | Mader | 37/283 |
| 2,728,598 | 12/1955 | Szillage | 294/53.5 |
| 2,763,506 | 9/1956 | Denker et al. | 294/57 |
| 4,289,344 | 9/1981 | Mitchell | 294/53.5 |
| 4,475,757 | 10/1984 | Glock | 294/51 |
| 5,114,199 | 5/1992 | Newcomer | 294/50.8 |
| 5,228,734 | 7/1993 | Pollastro | 294/54.5 |
| 5,511,328 | 4/1996 | Fingerer et al. | 294/54.5 |
| 5,533,768 | 7/1996 | Mitchell | 294/57 |

*Primary Examiner*—Dean Kramer
*Attorney, Agent, or Firm*—Anthony J. Dixon

[57] ABSTRACT

A folding shovel with a two part concave scoop hinged at the center wherein the scoop can be folded in half wherein the handle slides into the hinge and forms the hinge pin and wherein the handle is comprised of two sections, slidingly coupled to each other so that the top section can be removed from the bottom section to allow for compact storage of the entire unit. The top section, when removed, can be attached to a receptacle on the scoop to provide a storage receptacle to allow storing the entire shovel by hanging.

4 Claims, 2 Drawing Sheets

FOLDING SNOW SHOVEL

BACKGROUND OF THE INVENTION

1. Field of the Invention

The present invention relates to a shovel which can be folded in half to provide for compact storage. More particularly it relates to a folding shovel wherein the scoop or blade section is hinged to allow folding in half and wherein the handle acts as the hinge pin as well as the handle and wherein the handle also breaks down into two sections to provide for compact storage. Most particularly, it relates to the field of snow shovels which can be folded to provide compact storage.

2. The Prior Art

The field of folding shovels and the like is an old one with the most memorable entries being the military type folding spades popular with campers and outdoorsmen. In the field of snow shovels however, the use of folding shovels is not as well represented. A snow shovel is unique in that it provides a large, usually flat scoop section to allow for high volume movement of snow which is less dense than the earth usually moved by spades. The width of a snow shovel is its advantage in the movement of snow and its disadvantage in storage. Storage and transportation of such shovels is therefore a problem long felt in the art.

Although folding spades have been disclosed, such as those set forth in U.S. Pat. No. 4,475,757, issued to Glock, these types of shovels do not provide for the scoop or blade section to be foldable, rather the handle and blade are usually foldable, one with respect to the other. In that spade blades are usually of narrow configuration, this is a logical outcome in the prior art but it does not address the storage problem facing the owner of a snow shovel. The same limitation in the prior art is evidenced by U.S. Pat. No. 1,475,899, issued to Thibault and U.S. Pat. No. 122,206 issued to Wetmore. Thibault uses a handle/blade configuration wherein the two halves of the blade are locked together with the handle; however, the lug type assembly is not amenable to the snow shovel uses being addressed by the present invention. Wetmore merely uses a bayonet which slides into a one-piece scoop.

An expandable snow shovel has been disclosed by Pollastro in U.S. Pat. No. 5,228,734 wherein a base unit is expandable by adding pieces thereto one at a time to provide a wide scoop but the pieces are totally separate one from the other and the handle plays no part in the unique fashion set forth herein.

SUMMARY OF THE INVENTION

It is therefore an object of the present invention to provide an easily stored, foldable shovel with a concave scoop particularly adapted for the removal of snow.

It is a further object of the present invention to provide a snow shovel which can be disassembled and assembled easily for compact storage while providing a scoop large enough to allow for the efficient removal of snow.

It is a further object of the invention to meet a long-felt and unanswered need in the art of foldable shovels particularly those used in snow removal.

These and other objects and advantages are met by the present invention which provides a folding shovel with a concave scoop wherein the scoop comprises a first side and a second side, a two part interlocking hinge dispersed between said first and second scoop sides so that the two sides can rotate from 0° to 180° relative to each other so as to fold to one half the size when closed and to full size when opened to a full 180°; a socket formed by the hinge in which the shovel handle forms the socket pin when slidingly mounted therein and which handle is in two parts, a lower part which engages the hinge and an upper part which slidingly hooks to the lower part by insertion into a socket defined in the lower part, a grip attached to the upper end of the upper handle part and means for releasably attaching the upper handle to the lower handle and permanently attaching the lower handle to the hinge. The device further provides a flange mounted on one scoop side which engages the edge of the second scoop side at the 180° position to provide rigidity to the completely opened scoop section. Also, means for storing the entire device are provided by a storage socket mounted on one scoop side which can receive the upper handle portion which is inserted therein, and fastened thereto to provide means for hanging the entire structure for easy storage. A bottom edge is also provided along the edge of the scoop to provide rigidity and longer wearing properties.

BRIEF DESCRIPTION OF THE DRAWINGS

The device of the present invention is further described in the attached drawings in which.

DETAILED DESCRIPTION OF THE DRAWINGS

With reference to the drawings, a detailed description of the present invention follows.

Figure 2:
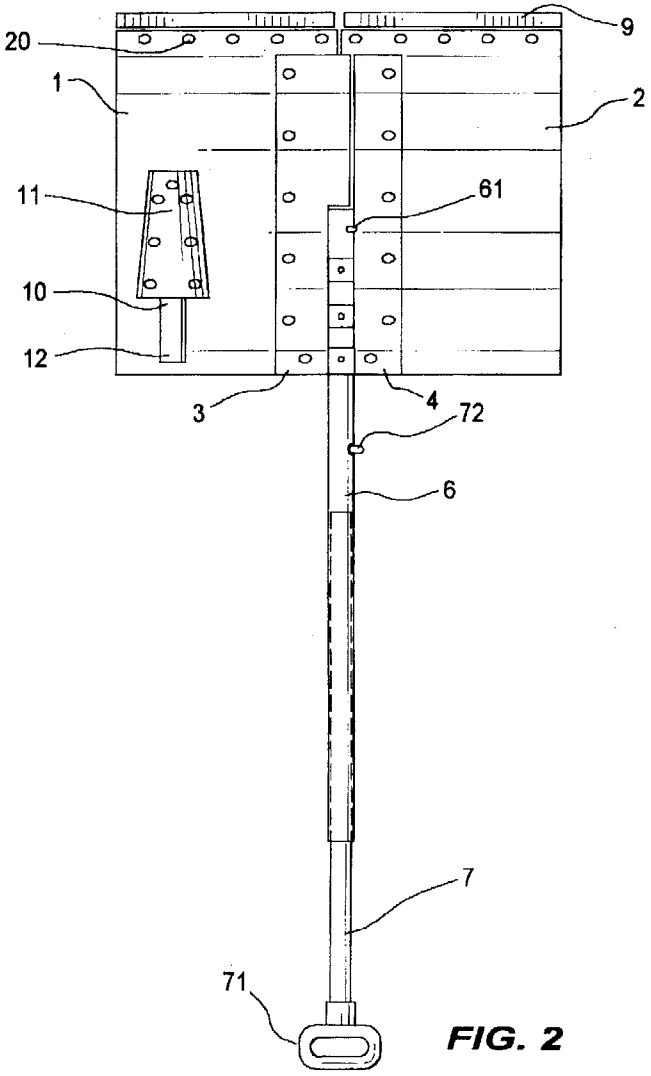
FIG. 2 is a rear view.
Figure 1:
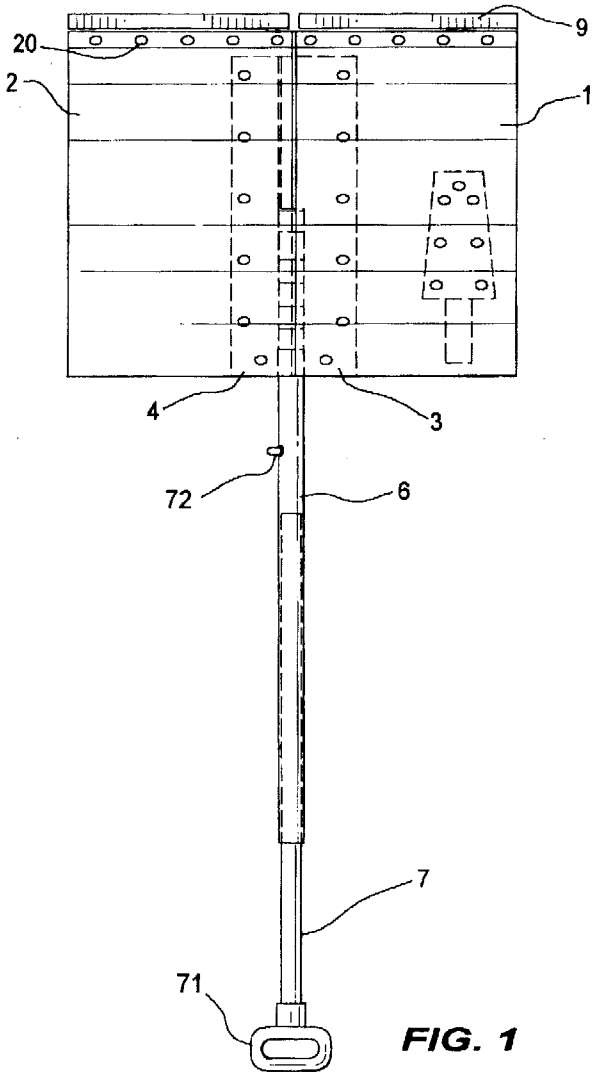
FIG. 1 is a front view.
Figure 4:
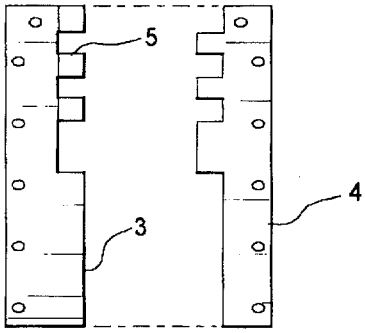
FIG. 4 is a front view of the hinges dissassembled.
Figure 5:
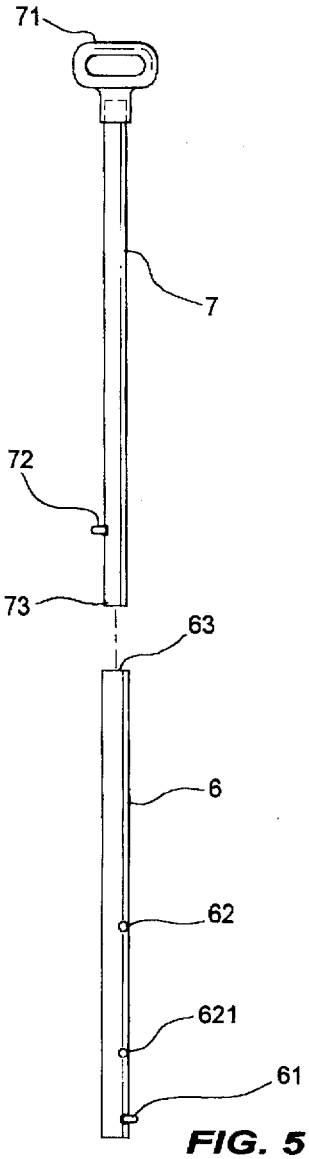
FIG. 5 is a front view of the handle dissassembled.

As set forth in FIG. 1 a front view of the entirely assembled invention can be seen. The scoop is made up of side, 1 and side, 2, each of generally concave configuration. On each side, one half of the hinge, 3 and 4, respectively, are fixedly mounted by rivets, 20, or the like, to the rear face as shown in FIG. 2. The two hinge halves engage to form a central socket, 5, into which the lower handle portion, 6, is fixedly attached to side, 1, at back of hinge, 3, permanently holding handle portion, 6, in place. When the two scoop sides are unfolded rearwardly, flange, 8, on side, 1, the same side to which handle portion, 6, is fixedly attached engages the edge of side, 2, to provide a rigid open position of 180° angle of side, 1 to side, 2. A spring pin or the like, 61, engages the hole provided in hinge, 5, at location, 51, to fix the handle in position. Also, fasteners, 511, can also be provided to fix this connection. This lower handle portion also has defined in its upper end, socket or receptacle, 63, which is accomodatingly wider than the upper handle portion, 7, insert portion, 73. Portion, 73 is slid into receptable, 63, to complete the handle. Spring pin, 72, engages hole, 62, in the lower handle portion to fix the connection between elements, 6 and 7. Hole, 621, is also provided to allow for handle length adjustment. FIGS. 4 and 5 show this interconnection between hinge elements, 3 and 4, and handle elements 6 and 7.

The upper end of element, 7, has handle portion, 71, mounted thereon to provide ease of use of the complete shovel assembly.

The device also is provided with bottom edge, 9, mounted on scoop portions 1 and 2 to provide a more efficient edge and one that will wear better. The scoop can be constructed of aluminum, for example, with a steel edge, 9, mounted thereon by rivets, 20, or the like.

Figure 3:
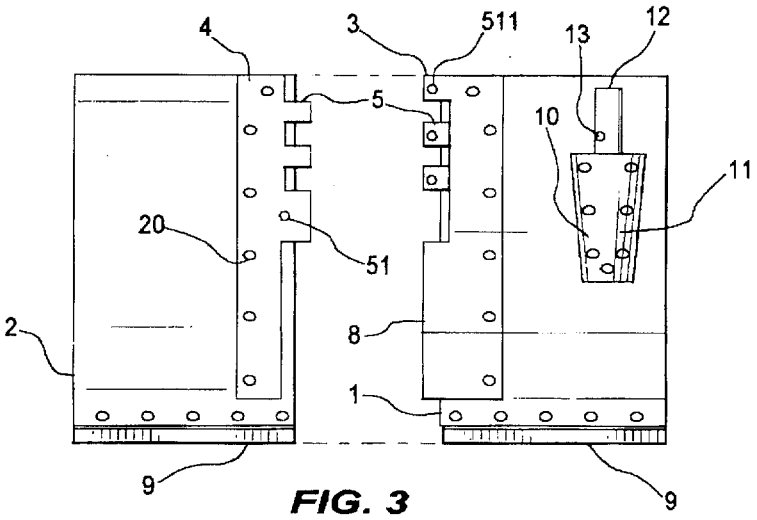
FIG. 3 is a rear view dissassembled.

When the device is to be stored, spring pin, 61, is disengaged to allow scoop side, 1, to rotate relative to scoop side, 2, thereby decreasing the size by 50%. Handle portion, 7, is removed from portion, 6, by disengaging pin, 72, from hole, 62, and removed. At this point, the insert end, 73, of upper handle portion, 7, can be inserted into the storage receptacle, 10, mounted on scoop side, 1, (see FIGS. 2 and 3) via plate, 11, and rivets, 20, or the like. This receptacle has an upper cylindrical portion, 12, which accomodates end, 73. Spring pin, 72, then engages hole, 13, and is fixedly attached. The handle grip, 71, then can hang on a storage hook and support the entire compact structure which is one half its size when opened for use.

Although the materials of construction are not a critical element of the present invention, the scoop will preferably be constructed from a light, rigid material such as aluminum or various plastics commercially available. In either case, the longer wearing edge member should be of a material resistant to wear such as a steel alloy which can be fixed to the scoop by rivets, or the like. The handle portions must be capable of withstanding the shovel pressure and also of having defined therein the sockets, pin holes and locking pins that form an integral part of the present invention. Various aluminum alloys are available which can meet these engineering standards.

It is also envisioned that minor modifications can be made without departing from the scope of the present invention as set forth in the attached claims.

I claim:

1. A folding shovel comprising:

a. a concave scoop having a first scoop side and a second scoop side;

b. a two part interlocking hinge dispersed between said first and second scoop sides wherein the two scoop sides can rotate 180° to each other;

c. a socket formed by the hinges;

d. a lower handle portion which has a bottom end and a top end, the bottom end slidingly dispersed in the hinge socket and fixedly attached to the first scoop side and the upper end having defined therein a central receptacle;

e. an upper handle portion which slides into the lower handle central receptacle;

f. a grip portion mounted on the upper handle portion;

g. means for permanently fastening the lower handle to the hinge;

h. means for releasably fastening the upper handle to the lower handle;

i. a flange mounted on the first side of the scoop adjacent to the hinge and extending beyond the scoop which engages the second side of the scoop to resist rotating of the two sides beyond 180° relative to each other.

2. The folding shovel of claim 1 which further comprises an edge member fixedly attached to the bottom edge of the first scoop side and the bottom edge of the second scoop side.

3. The folding shovel of claim 2 which further comprises a storage receptacle mounted on the outside face of the first scoop side, said storage receptacle being accommodatingly larger than the upper handle portion and means for releasably fastening the upper handle portion to the storage receptacle to provide for compact hanging storage of the folding shovel.

4. The folding shovel of claim 3 wherein the means for releasably attaching the upper handle to the lower handle is a spring pin and the means for attaching the upper handle to the storage receptacle is a spring pin.

* * * * *